US005421269A

United States Patent [19]

Lipsius et al.

[11] Patent Number: 5,421,269

[45] Date of Patent: Jun. 6, 1995

[54] RADIALLY ADJUSTABLE RUNNING GEAR FOR A RAILBORNE VEHICLE

[75] Inventors: Johann M. Lipsius; Wolfgang Auer, both of Kassel, Germany

[73] Assignee: ABB Patent GmbH, Mannheim, Germany

[21] Appl. No.: 203,284

[22] Filed: Feb. 28, 1994

[30] Foreign Application Priority Data

Feb. 27, 1993 [DE] Germany ..... 43 06 113.3

[51] Int. Cl.[6] ..... B61F 5/38

[52] U.S. Cl. ..... 105/168

[58] Field of Search ..... 105/165, 167, 168

[56] References Cited

U.S. PATENT DOCUMENTS 4,170,179 10/1979 Vogel ..... 105/168
4,676,172 6/1987 Bullock ..... 105/168
5,249,530 10/1993 Wike ..... 105/168
5,263,420 11/1993 Schwendt et al. ..... 105/168 X

FOREIGN PATENT DOCUMENTS 0387744 9/1990 European Pat. Off. .
2575429 7/1986 France .
3827412 1/1991 Germany .

*Primary Examiner*—Robert J. Oberleitner
*Assistant Examiner*—S. Joseph Morano
*Attorney, Agent, or Firm*—Herbert L. Lerner; Laurence A. Greenberg

[57] ABSTRACT

A railborne vehicle includes a truck with two sides and double-axle truck frames, wheelsets with wheels on each side of the truck, wheelset bearing/axle bearing housings for the two wheels of each side, and wheelset guide rods and compensating levers connecting the wheelset bearing/axle bearing housings of the two wheels of each side to one another. A radially adjustable running gear for the railborne vehicle includes a horizontally displaceable but vertically rigid wrist point longitudinally displaceably securing the wheelset guide rod to the truck frame. A connecting guide rod is connected between the wheelset guide rod and the compensating lever. Respective articulation points connect the connecting guide rod to the wheelset guide rod and the compensating lever.

5 Claims, 3 Drawing Sheets

RADIALLY ADJUSTABLE RUNNING GEAR FOR A RAILBORNE VEHICLE

BACKGROUND OF THE INVENTION

1. Field of the Invention

The invention relates to a radially adjustable running gear or undercarriage for a railborne vehicle which may be used both in locomotives and in non-driven railborne vehicles, and which has double-axle truck or bogie frames, wherein wheelset bearing/axle bearing housings of the two wheels of each side of the truck are connected to one another through wheelset guide rods and compensating levers.

One such radially adjustable running gear for a railborne vehicle is known, for instance, from German Patent DE 38 27 412 C2. That publication describes a running gear for locomotives having at least two wheel cases with axle bearings which are displaceable in an essentially horizontal plane relative to a vehicle frame by means of wheelset guide rods. The guide rods, which are constructed as articulated levers, are secured rigidly at their ends facing away from the axle bearings, through compensating levers, to a common pivot shaft, which is supported on the vehicle frame.

Connecting wheelset guide rods to the compensating levers directly requires an inclination from the horizontal on the part of the wheelset guide rods. Upon spring deflection of the wheelset, this causes longitudinal displacements with respect to the spacing between the wheelset axles of the right and left sides of the bogie or truck, wherein such displacements are contrary to one another because of the differing inclination of the wheelset guide rods of the right and left wheelset bearing of one axle. A radial control which is thus solely brought about by the spring deflection increases the wear of the wheels and rails, decreases the force-locking guidance of the vehicle, and lessens the quietness of operation. A force-locking connection is one which connects two elements together by force external to the elements, as opposed to a form-locking connection which is provided by the shapes of the elements themselves.

SUMMARY OF THE INVENTION

It is accordingly an object of the invention to provide a radially adjustable running gear for a railborne vehicle, which overcomes the hereinafore-mentioned disadvantages of the heretofore-known devices of this general type and in which the slightest possible longitudinal displacements occur with respect to the spacing between the wheelset axles of the right and left sides of the bogie or truck during a spring deflection.

With the foregoing and other objects in view there is provided, in accordance with the invention, in a railborne vehicle having a truck with two sides and double-axle truck frames, wheelsets with wheels on each side of the truck, wheelset bearing/axle bearing housings for the two wheels of each side, and wheelset guide rods and compensating levers connecting the wheelset bearing/axle bearing housings of the two wheels of each side to one another, a radially adjustable running gear for the railborne vehicle, comprising a horizontally displaceable but vertically rigid wrist point longitudinally displaceably securing the wheelset guide rod to the truck frame; a connecting guide rod connected between the wheelset guide rod and the compensating lever; and respective articulation points connecting the connecting guide rod to the wheelset guide rod and the compensating lever.

The advantages attainable with the invention are in particular that spring deflection is possible without giving rise to attendant disrupting radial control motions, since the wheelset guide rods are not disposed obliquely but rather horizontally. Since only minimal longitudinal motions occur upon spring deflection as a result, the utilization of the coefficient of friction of the wheels remains optimal in terms of pulling and braking forces. Major quietness of operation results even during spring deflection. The wear to wheels and rails is thus lessened.

In accordance with another feature of the invention, the horizontally displaceable but vertically rigid wrist point together with the articulation points for the wheelset guide rods and the connecting rods, are constructed as a longitudinally displaceable double joint.

In accordance with a further feature of the invention, the wheelset guide rod has its own articulation point securing the connecting guide rod which is separate from the horizontally displaceable wrist point, for fastening to the truck frame.

In accordance with an added feature of the invention, the horizontally displaceable wrist point is disposed between the articulation point for the connecting guide rod and an end of the wheelset guide rod pointing toward the truck frame, and the connecting guide rod has a hooked shape fitting around the wrist point.

In accordance with a concomitant feature of the invention, there is provided a rigid pivot shaft connecting the two compensating levers for radial control in opposite directions on right and left sides of the truck.

Other features which are considered as characteristic for the invention are set forth in the appended claims.

Although the invention is illustrated and described herein as embodied in a radially adjustable running gear for a railborne vehicle, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings.

DESCRIPTION OF THE PREFERRED EMBODIMENTS

Figure 1:
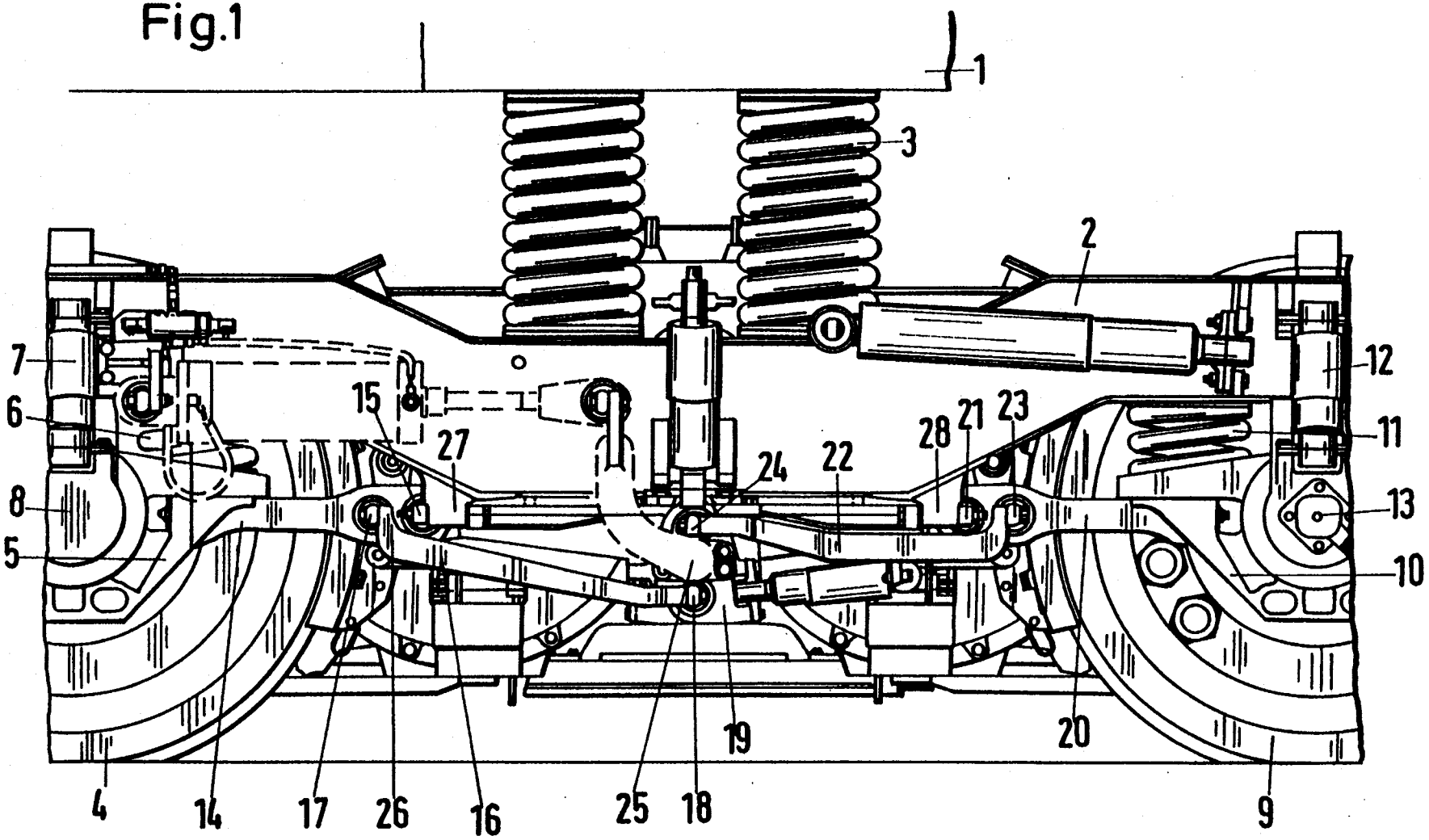
FIG. 1 is a fragmentary, diagrammatic, side-elevational view of a radially adjustable running gear for a railborne vehicle.

Referring now to the figures of the drawing in detail and first, particularly, to FIG. 1 thereof, there is seen a radially adjustable running gear or undercarriage for a railborne vehicle. A bogie or truck frame 2 is suspended from a car box 1 of a railborne vehicle. Spring elements 3 serve to provide suspension for the car box 1. Two wheel sets are suspended from the bogie or truck frame 2. A first wheel 4 of a first wheelset and a first wheel 9 of a second wheelset can be seen. An axle bearing housing 5 with a wheelset bearing of the first wheel 4 of the first wheelset is supported on the bogie or truck frame 2 through wheelset spring elements 6 and wheelset damping elements 7. A first wheelset axle is indicated by reference numeral 8.

An axle bearing housing 10 with a wheelset bearing of the first wheel 9 of the second wheelset is supported in the same manner on the bogie or truck frame 2 through wheelset spring elements 11 and wheelset damping elements 12. A second wheelset axle is identified by reference numeral 13.

A wheelset guide rod 14 is connected rigidly to the axle bearing housing 5 on one end and pivotably to the bogie or truck frame 2 on the other end through a wrist point 15. The wrist point 15 is displaceable horizontally but not vertically and represents a pivot point for deflections of the wheelset guide rod 14. A connecting guide rod 16 serves to couple the wheelset guide rod 14 to a compensating lever 19. To that end, the guide rod 16 is connected both to the wheelset guide rod 14 through an articulation point 17, and to the compensating lever 19 through an articulation point 18.

In the same way, a wheelset guide rod 20 is connected rigidly to the axle bearing housing 10 on one end and pivotably to the bogie or truck frame 2 on the other through a wrist point 21. The wrist point 21 is displaceable horizontally but not vertically and represents a pivot point for deflections of the wheelset guide rod 20. A connecting guide rod 22 serves to couple the wheelset guide rod 20 to the compensating lever 19. To that end, the guide rod 22 is connected both to the wheelset guide rod 20 through an articulation point 23, and to the compensating lever 19 through an articulation point 24.

A pivot point 25 of the compensating lever 19 is located centrally between the two articulation points 18, 24, and in the position of repose, in other words when the railborne vehicle is traveling straight ahead, these articulation points are oriented vertically.

As can be seen from the geometrical configuration of the connections between the wheelset guide rods 14, 20, the connecting guide rods 16, 22 and the compensating lever 19, the result when the railborne vehicle travels around curves is radial control that is symmetrical with respect to the two wheelsets. If the two wheels 4, 9 are running on the rail on the inside of the curve, then the compensating lever 19 executes a counterclockwise rotary motion about the pivot point 25, and as a result the distance between the two axle bearing housings 5, 10 decreases in comparison with the position of repose. If the two wheels 4, 9 are running on the rail on the outside of the curve, then the compensating lever 19 executes a clockwise rotary motion about the pivot point 25, and as a result the distance between the two axle bearing housings 5, 10 increases in comparison with the position of repose.

Wrist blocks 27 and 28 on the bogie or truck frame 2 serve to secure the horizontally displaceable wrist points 15 and 21, respectively. It is possible to use the same wrist blocks of the kind which is also used with direct fastening (with a fixed wrist point) of the wheelset guide rods solely to the bogie or truck frame and not to compensating levers. As a result, one and the same bogie or truck frame can be used both for the tandem disposition of the guide rods of the wheelset guide (wheelset guide rods plus connecting guide rods) according to the invention as well as for the exclusive securing of the wheelset guide rods to the bogie or truck frame. The connecting guide rods 16, 22 have a hooked shape 26, in order to circumvent the horizontally displaceable wrist points 15, 21 (see also FIG. 5).

Figure 2:
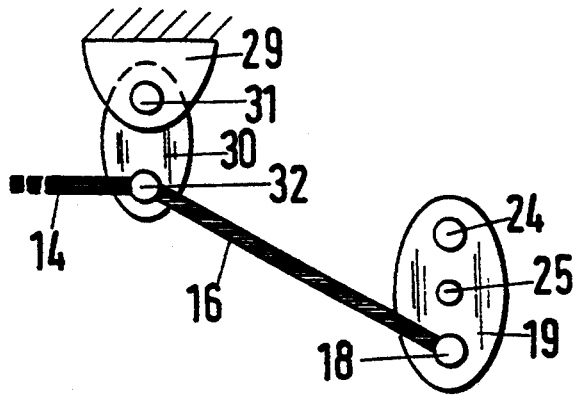
FIGS. 2–5 are highly diagrammatic, side-elevational views of various options for constructing a horizontally displaceable double joint.

FIGS. 2–5 show various options for constructing a horizontally displaceable double joint. In structural terms, two joints and longitudinal displaceability must all be achieved at a single point. Placing the joints side by side and superimposing them on one another both produce complicated constructions. The guide rod fastening points on the bogie or truck frame 2 are integrated into the construction and should remain unchanged as much as possible, so that the bogie or truck frame can be used universally, as was already discussed at the outset. In FIG. 2, a Wrist block 29 is secured to the bogie or truck frame 2 and is connected to a lever 30 through an articulation point 31. Both wheelset guide rods 14 and connecting guide rods 16 are secured to a further articulation point 32 of the lever 30, which is located vertically below the articulation point 31. The other end of the connecting guide rod 16 is connected to the articulation point 18 of the compensating lever 19. In the configuration of FIG. 2, vertical "migration" of the articulation point 32 results upon spring deflection of the wheelset.

Figure 3:
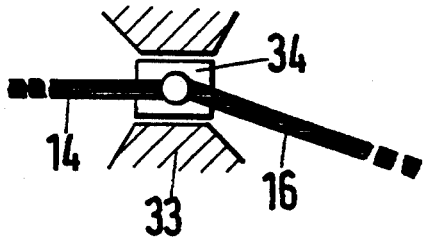

In FIG. 3, a wrist block 33 is secured to the bogie or truck frame 2 and has inside running surfaces which permit horizontal displacement of a joint 34. The joint 34 is constructed as a double joint for securing the wheelset guide rod 14 and the connecting guide rod 16. Although this variant is optimal in terms of its geometrical configuration, nevertheless it may be vulnerable to impact strains.

Figure 4:
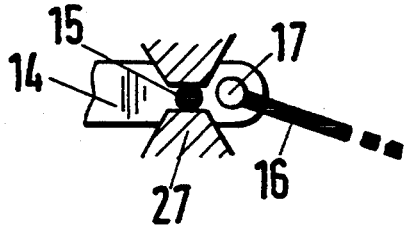
Figure 5:
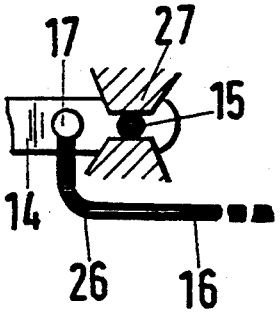

In the configurations of FIGS. 4 and 5, wrist point 15 and the articulation point 17 are "spread apart", but the spacing between the two articulation points is very slight, and the resultant ensuing longitudinal displacement of the wheelset bearing/axle bearing housing upon spring deflection of the wheelset is negligibly small.

In FIG. 4, the wrist point 15 is constructed as a rotationally movable bolt that is horizontally displaceable along a guide of the wrist block 27 and is secured to the wheelset guide rod 14. The articulation point 17 for the connecting guide rod 16 is mounted on the end of the wheelset guide rod 14 pointing in the direction of the compensating lever.

The configuration of FIG. 5 is equivalent to the configuration already shown in FIG. 1, with the connecting guide rod 16 having the hooked shape 26 in the vicinity of the articulation point 17 being connected to the wheelset guide rod 14. The wrist point 15, which is in the form of a rotationally movable bolt being horizontally displaceable along a guide of the wrist block 27, is located between the articulation point 17 and the end of the wheelset guide rod 14 pointing in the direction of the compensating lever.

Figure 6:
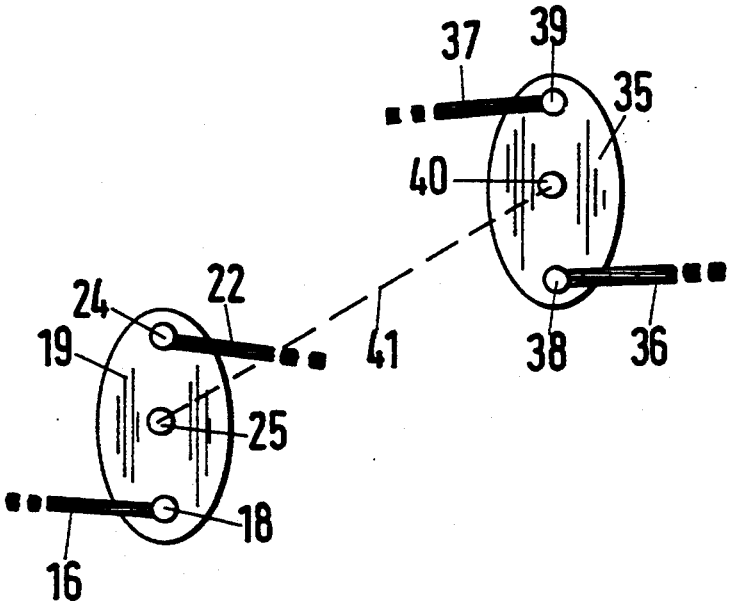
FIG. 6 is a highly diagrammatic, perspective view of a coupling of both compensating levers of a bogie or truck.

In FIG. 6, the coupling of the two compensating levers of a bogie or truck is shown. The above-described tandem configuration of the guide rods of the wheelset guide (wheelset guide rod plus connecting guide rod) on the right and left sides of the bogie or truck is assumed. The compensating lever 19 with the articulation points 18, 24 and the pivot point 25, as well as a compensating lever 35 of the other side of the bogie or truck with articulation points 38, 39 and a pivot point 40 can all be seen. These compensating levers for radial control on the right and left sides of the bogie or truck are connected to a rigid pivot shaft (or tube) 41, which is supported in two or more rotary bearings in the bogie or truck frame 2 or in an intermediate split bearing. The bearings serve to transmit tensile forces. The articulation points 18, 24 for the connecting guide rods 16, 22 and the articulation points 38, 39 for connecting guide rods 36, 37 are each disposed vertically. The guide rod connection with the wheelset bearings/axle bearing housings and with the base points or fastening points to the wheelset guide rods is effected in such a way that the right and left wheelset bearings are controlled in opposite directions. The center of the wheelset longitudinally is advantageously not displaced if tensile force is exerted (radial control). Due to the coupling of the two bogie or truck sides, when tensile force is exerted on only one side of the bogie or truck the resultant longitudinal forces do not bring about any problematic control motions. Undesirable influence from longitudinal forces upon travel in curves and along straight lines does not occur.

We claim:

1. In a railborne vehicle having a truck with two sides and double-axle truck frames, wheelsets with wheels on each side of the truck, axle bearing housings for the two wheels of each side, and wheelset guide rods and compensating levers connecting the axle bearing housings of the two wheels of each side to one another, a radially adjustable running gear for the railborne vehicle, comprising:

a horizontally displaceable but vertically rigid wrist point longitudinally displaceably securing at least one of the wheelset guide rods to the truck frame;

a connecting guide rod connected between the one wheelset guide rod and at least one of the compensating levers; and respective articulation points connecting said connecting guide rod to the one wheelset guide rod and the one compensating lever.

2. The running gear according to claim 1, wherein said horizontally displaceable but vertically rigid wrist point together with said articulation points for the one wheelset guide rod and the connecting guide rod is constructed as a longitudinally displaceable double joint.

3. The running gear according to claim 1, wherein said articulation point connected between said one wheelset guide rod and said connecting guide rod is separate from said horizontally displaceable wrist point, for fastening to the truck frame.

4. The running gear according to claim 3, wherein said horizontally displaceable wrist point is disposed between said articulation point for said connecting guide rod and an end of said one wheelset guide rod pointing toward the truck frame, and said connecting guide rod has a hooked shape fitting around said wrist point.

5. The running gear according to claim 1, including a rigid pivot shaft connecting said two compensating levers for radial control in opposite directions on right and left sides of the truck.

* * * * *